US009256201B2

(12) United States Patent
Satou et al.

(10) Patent No.: US 9,256,201 B2
(45) Date of Patent: Feb. 9, 2016

(54) IMAGE FORMING APPARATUS

(71) Applicant: Konica Minolta, Inc., Chiyoda-ku, Tokyo (JP)

(72) Inventors: Mitsuru Satou, Toyokawa (JP); Dong Zhang, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/697,850

(22) Filed: Apr. 28, 2015

(65) Prior Publication Data

US 2015/0316891 A1 Nov. 5, 2015

(30) Foreign Application Priority Data

Apr. 30, 2014 (JP) ..... 2014-093401

(51) Int. Cl.
*G03G 21/20* (2006.01)

(52) U.S. Cl.
CPC ..... *G03G 21/206* (2013.01); *G03G 21/203* (2013.01)

(58) Field of Classification Search
CPC ..... G03G 21/203; G03G 21/206
See application file for complete search history.

(56) References Cited

U.S. PATENT DOCUMENTS 3,890,721 A * 6/1975 Katayama ..... G03G 15/107 118/628
4,093,368 A * 6/1978 Nishikawa ..... G03G 15/052 399/135
4,178,092 A * 12/1979 Yamamoto ..... G03G 21/206 250/324
4,760,423 A * 7/1988 Holtje ..... B01D 53/02 355/30
5,689,766 A * 11/1997 Hollar ..... G03G 21/206 399/92
5,819,137 A * 10/1998 Hoffman ..... G03G 21/206 399/100
6,477,347 B2 * 11/2002 Yokota ..... G03G 15/5008 399/250
6,621,554 B1 * 9/2003 Ayash ..... G03G 21/206 355/30
6,714,229 B2 * 3/2004 Miyazaki ..... B41J 29/377 347/223
8,351,815 B2 * 1/2013 Eden ..... G03G 21/206 399/92
8,391,741 B2 * 3/2013 Fujii ..... G03G 15/5004 399/43
8,989,617 B2 * 3/2015 Shalem ..... G03G 21/206 399/92
2003/0086722 A1 * 5/2003 Nakazato ..... G03G 21/203 399/93
2005/0152713 A1 * 7/2005 Maeda ..... G03G 21/206 399/93
2005/0180772 A1 * 8/2005 Dergham ..... G03G 21/206 399/92

(Continued)

FOREIGN PATENT DOCUMENTS

JP 03094280 A * 4/1991
JP 3-267954 A 11/1991

(Continued)

*Primary Examiner* — David Bolduc
(74) *Attorney, Agent, or Firm* — Buchanan Ingersoll & Rooney PC

(57) ABSTRACT

An image forming apparatus having: a filter member configured to trap particles floating in the apparatus; a suction section configured to suck air including the particles at a variable suction rate; a determiner configured to determine the suction rate of the suction section; an exhaust path capable of leading the air sucked by the suction section to outside of the apparatus through the filter member; a circulation path capable of allowing the air sucked by the suction section and passing through the filter member to circulate inside the apparatus; a switching member configured to make switches between the exhaust path and the circulation path; and a control unit configured to control at least the suction section and the switching member. The control unit allows the switching member to open the exhaust path only when the suction rate determined by the determiner is equal to or less than a predetermined value.

15 Claims, 12 Drawing Sheets

(56) References Cited

U.S. PATENT DOCUMENTS

2005/0244184 A1* 11/2005 Kim ..... G03G 15/107 399/93
2006/0093394 A1* 5/2006 Shirakata ..... G03G 21/206 399/93
2007/0009283 A1* 1/2007 Shirakata ..... G03G 21/206 399/92
2007/0019981 A1* 1/2007 Kawamata ..... G03G 15/6573 399/92
2007/0122177 A1* 5/2007 Doi ..... G03G 15/2064 399/93
2008/0308255 A1* 12/2008 Sasahara ..... G03G 21/206 165/58
2009/0274493 A1* 11/2009 Ishikawa ..... F04B 7/00 399/323
2011/0142482 A1* 6/2011 Nakashima ..... G03G 21/206 399/93
2011/0211859 A1* 9/2011 Shimoyama ..... G03G 15/2064 399/93
2011/0315247 A1* 12/2011 Yamamiya ..... G03G 21/206 137/561 R
2014/0093269 A1* 4/2014 Hirasawa ..... F24F 11/006 399/92

FOREIGN PATENT DOCUMENTS

JP 11-249510 A 9/1999
JP 2006259280 A * 9/2006
JP 2007-171921 A 7/2007
JP 2009-151075 A 7/2009

* cited by examiner

IMAGE FORMING APPARATUS

This application claims benefit of priority to Japanese Patent Application No. 2014-093401 filed Apr. 30, 2014, the content of which is incorporated herein by reference.

BACKGROUND OF THE INVENTION

1. Field of the Invention

The present invention relates to an image forming apparatus, and more particularly to a copier, a printer, a facsimile or any other electrophotographic image forming apparatus that transfers a toner image on a recording sheet and thereafter applies heat to the recording sheet for fixation of the toner image thereon.

2. Description of Related Art

An image forming apparatus that forms a toner image on a recording sheet by an electrophotographic process comprises a fixing device configured to apply heat to the recording sheet for fixation of the toner image thereon. It is known that when the fixing device is driven, heat is generated, which causes emanation of a volatile material from rollers and other parts of the fixing device. Further, recently, it has been found that ultrafine particles (particles with diameters not more than about 1000 nm) are generated from the volatile material and discharged from the image forming apparatus.

The ultrafine particles discharged from the image forming apparatus are a tiny amount, and the tiny amount of ultrafine particles themselves cause no particular damage to human health or environments. However, with increasing awareness of environmental issues, it is desirable that such apparatuses are put under emission control to prevent even a tiny amount of emission. Also, it is expected that toner particles become still finer, and it would be necessary to control emission of such toner particles from image forming apparatuses.

For example, Japanese Patent Laid-Open Publication No. 2007-171921 discloses a technical skill to trap exhaust emissions efficiently inside an image forming apparatus. In an image forming apparatus disclosed in Japanese Patent Laid-Open Publication No. 2007-171921, in order to prevent volatile organic compounds generated inside the image forming apparatus from being discharged therefrom, while air is circulated around a fixing device, a filter provided in the circulation path traps the volatile organic compounds.

Japanese Patent Laid-Open Publication No. 2009-151075 discloses an image forming apparatus wherein a circulation path is switchable between an inner circulation path and an outer circulation path for the purpose of dew condensation prevention. The circulation path is switched to the inner circulation path or the outer circulation path, depending on the temperature and the humidity inside and outside the image forming apparatus, and thereby, condensation on an exposure device and contamination of a glass surface by a filter are prevented.

Japanese Patent Laid-Open Publication No. H3-267954 discloses an electrophotographic apparatus wherein while exhaust air from a suction section for sucking and conveying a sheet is circulated inside the apparatus, a filter traps toner, ozone and other matters.

However, as Japanese Patent Laid-Open Publication No. 2007-171921 discusses, circulating the air that has once passed through a filter inside an apparatus is circulating heated air inside an apparatus, which may cause a rise in the temperature inside the apparatus. Also, as Japanese Patent Laid-Open Publication No. 2009-151075 discusses, in a case where the switch of the circulation path between the inner circulation path and the outer circulation path depends on the temperature and the humidity inside and outside the apparatus, relatively large particles such as dust and toner can be trapped.

As concerns ultrafine particles, however, if the discharge speed from the apparatus is too high, the ultrafine particles may pass through the filter and be discharged from the apparatus. Circulating the exhaust air from the suction section inside the apparatus as taught in Japanese Patent Laid-Open Publication No. H3-267954 may cause a problem of a temperature rise inside the apparatus, as in the apparatus disclosed in Japanese Patent Laid-Open Publication No. 2007-171921.

Generally, by heightening the efficiency of removing fine particles by a filter, the trapping efficiency is improved, but the pressure loss becomes higher. In order to address the problem, a greater power source (fan) is necessary, which causes problems in terms of cost, space, energy-saving and noise. With regard to a sheet suction section, lowering the flow rate too much impairs stable sheet conveyance and separation between sheets. Also, with regard to trapping of ultrafine particles, a high flow rate causes ultrafine particles to slip through a filter, which results in a decrease in the trapping efficiency. Thus, in terms of particle trapping efficiency, it is desired that the flow rate is minimized.

SUMMARY OF THE INVENTION

An object of the present invention is to provide an image forming apparatus that is capable of trapping particles floating inside the apparatus efficiently so as to reduce emission of the particles to the outside of the apparatus.

An image forming apparatus according to an embodiment of the present invention comprises: an image forming section configured to transfer a toner image to a recording sheet and to fix the toner image on the recording sheet by heat; a filter member configured to trap particles floating in the image forming apparatus; a suction section configured to suck air including the particles at a variable suction rate; a determiner configured to determine the suction rate of the suction section; an exhaust path capable of leading the air sucked by the suction section to outside of the image forming apparatus through the filter member; a circulation path capable of allowing the air sucked by the suction section and passing through the filter member to circulate inside the image forming apparatus; a switching member configured to make switches between the exhaust path and the circulation path; and a control unit configured to control at least the suction section and the switching member, wherein the control unit allows the switching member to open the exhaust path only when the suction rate determined by the determiner is equal to or less than a predetermined value.

DETAILED DESCRIPTION OF THE PREFERRED EMBODIMENTS

Figure 1:
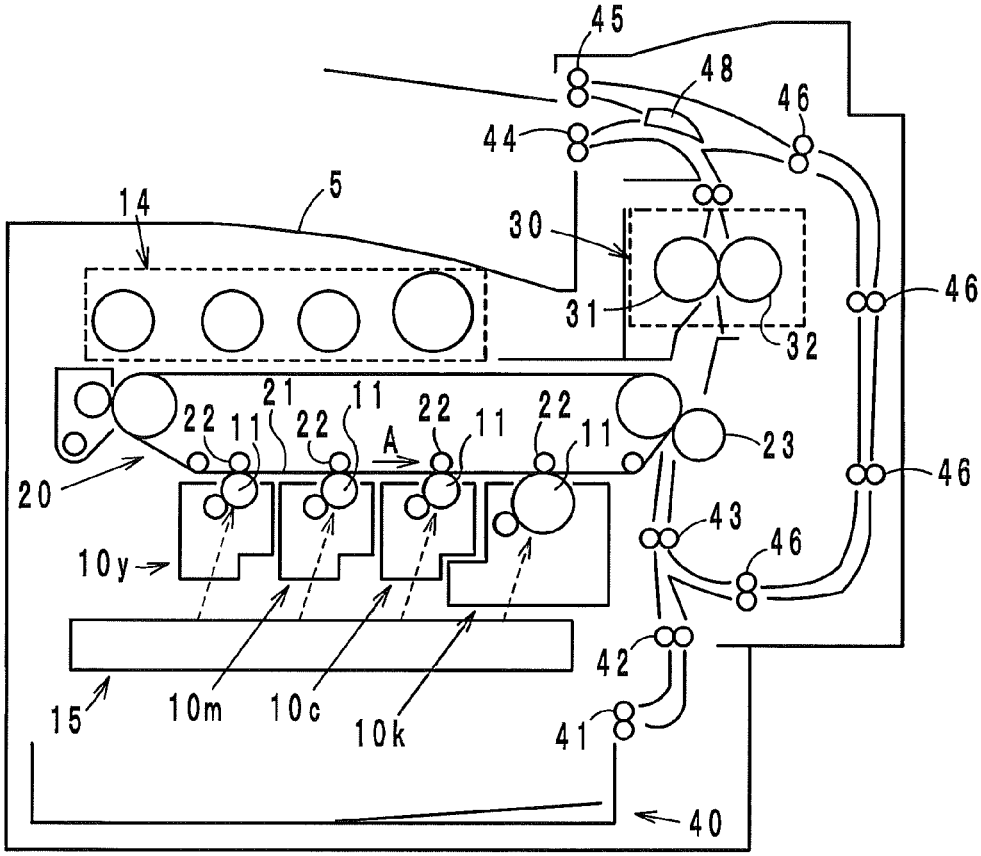
FIG. 1 is a schematic view of a printer that is an image forming apparatus according to an embodiment of the present invention.

An image forming apparatus according to an embodiment of the present invention is described with reference to the drawings. In the drawings, the same members and the same parts are provided with the same reference symbols, and the same descriptions are not repeated.

General Structure of Image Forming Apparatus; See FIGS. 1 and 2

Referring to FIG. 1, an image forming apparatus according to an embodiment is described. The image forming apparatus is a color printer of a tandem type. The printer generally comprises image forming units 10 (10*y*, 10*m*, 10*c*, 10*k*) configured to form toner images in colors of Y, M, C and K, respectively, a toner replenishing unit 14, a laser scanning unit 15, an intermediate transfer unit 20, and a fixing device 30.

Each of the image forming units 10 includes a charging roller, a developing device, a residual toner/charge cleaner, etc. (not shown) arranged around a photoreceptor drum 11. In the image forming units 10, the photoreceptor drums 11 are irradiated with lasers emitted from the laser scanning unit 15, and thereby, electrostatic latent images are written on the photoreceptor drums 11. Then, the electrostatic latent images are developed into toner images.

The intermediate transfer unit 20 includes an endless intermediate transfer belt 21 to be driven to rotate in a direction indicated by arrow A. By electric fields applied from first transfer rollers 22 opposed to the respective photoreceptor drums 11, the toner images formed on the photoreceptor drums 11 are transferred to the intermediate transfer belt 21 so as to be combined to form a composite image (first transfer). Such an electrophotographic process is well known, and a detailed description thereof is omitted.

In a lower section of the printer body, an automatic sheet feeder unit 40 is provided. The sheet feeder unit 40 is configured to feed recording sheets (which will be hereinafter referred to as sheets) one by one. A sheet is fed from a feed roller 41 to a pair of rollers 42, and further fed to a nip portion between the intermediate transfer belt 21 and a secondary transfer roller 23 via a pair of timing rollers 43. In the nip portion, the toner image (composite color image) is transferred to the sheet (second transfer). Thereafter, the sheet is fed to the fixing device 30, where the sheet undergoes a heating treatment for fixation of the toner image thereon. Then, the sheet is ejected to a printed-sheet tray 5 provided on an upper surface of the printer body through a pair of ejection rollers 44.

The printer according to this embodiment is operable in a single-side printing mode and in a double-side printing mode, and a switching member 48 is provided to switch the sheet path toward the pair of rollers 44 or a pair of rollers 45. In the single-side printing mode, a printed sheet is guided by a lower surface of the switching member 48 to be ejected through the pair of ejection rollers 44. In the double-side printing mode, a sheet with an image printed and fixed only on its first side is guided by an upper surface of the switching member 48 to the pair of rollers 45, and the sheet is fed backward by the pair of rollers 45. Then, the sheet is fed downward in a sheet path for double-side printing, which includes pairs of conveyance rollers 46, and returns to the pair of timing rollers 43. Thereafter, the second side of the sheet is printed, and the sheet passes through the fixing device 30 and is ejected to the printed-sheet tray 5 through the pair of ejection rollers 44.

The fixing device 30 is of a conventional type that includes a heating roller 31 to be heated by a heat source (not illustrated in the drawings), and a pressing roller 32 configured to support a sheet on its back surface. The heat source may be of a heat generating type, an electromagnetic induction type or any other type.

Figure 2:
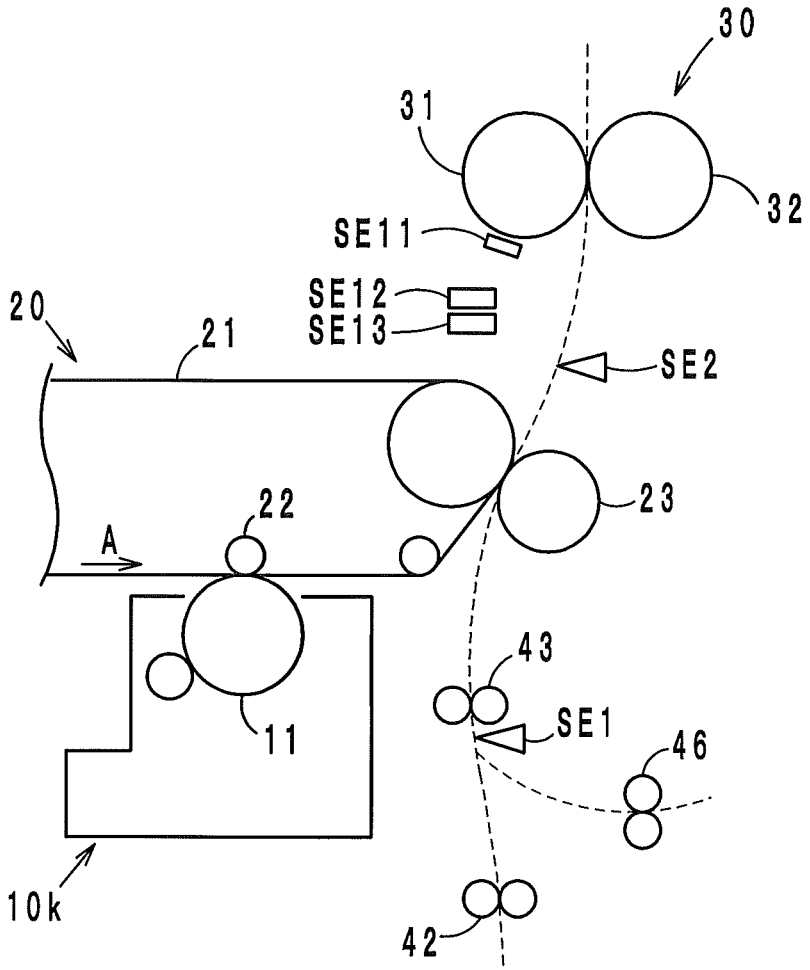
FIG. 2 is an elevational view of a sheet path (toner image transfer section) in the printer.

The sheet path is formed as indicated by dotted lines in FIG. 2. Along the sheet path, a sheet sensor SE1 is provided immediately before the pair of timing rollers 43, and a sheet sensor SE2 is provided between the second transfer section and the fixing device 30.

First Example of Exhaust Section; FIGS. 3-7

In order to ensure a sheet to be peeled from the intermediate transfer belt 21 and to stabilize the behavior of a sheet traveling in the sheet path, a suction section 50 is provided near the fixing device 30. The suction section 50 takes in air through an inlet 52 formed in a guide member 51 to suck a sheet in a direction indicated by arrow a. The suction section 50 also functions to dissipate the heat generated by the fixing device 30. The inlet 52 includes a large number of small holes pierced in the guide member 51 in a direction perpendicular to the sheet feeding direction. As mentioned, while the fixing device 30 is operating, heat is generated, whereby volatile matters emanate from the rollers 31, 32 and other parts of the fixing device 30. Further, toner floats in the second transfer section. Therefore, fine particles of these matters (the volatile matters and the toner) are possibly released from the suction section 50 to the outside of the apparatus.

Figure 3:
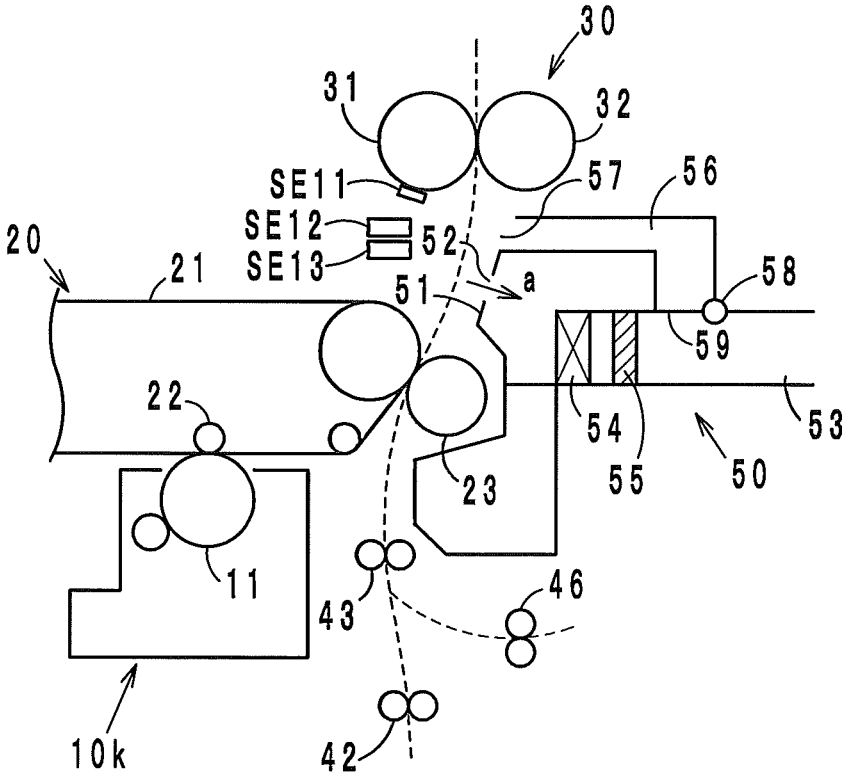
FIG. 3 is an elevational view of a first example of an exhaust section of the printer.

In view of this situation, the suction section 50 needs to have a configuration to minimize the chances to eject the fine particles. A first example of the suction section 50 having such a configuration is described below. As illustrated in FIG. 3, the suction section 50 includes an exhaust path 53 for leading air to the outside of the apparatus and a circulation path 56 for allowing air to circulate inside the apparatus. The inlet 52 serves as an air inlet of the exhaust path 53. In the exhaust path 53, a suction fan 54 is provided, and downstream of the suction fan 54, a filter 55 configured to trap fine particles is provided. The filter 55 is preferably a static filter that is capable of trapping ultrafine particles as typified by low-molecular siloxane.

Figure 4:
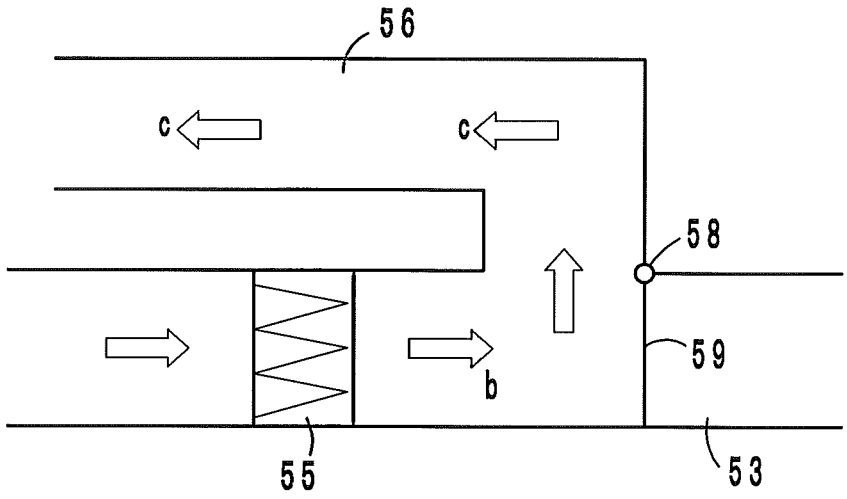
FIG. 4 is an illustration diagram of a circulation path in the printer.
Figure 5:
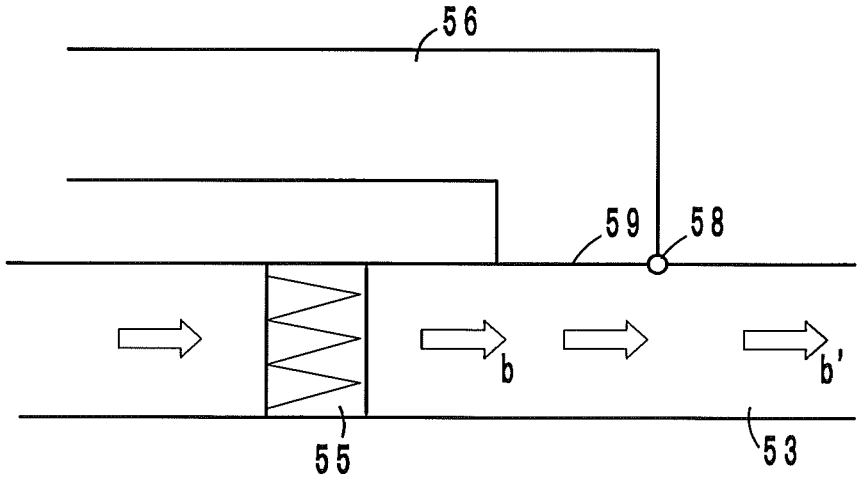
FIG. 5 is an illustration diagram of an exhaust path to the outside of the printer.

The circulation path 56 branches off upward from the exhaust path 53 at a downstream position of the filter 55 and extends to the underneath of the fixing device 30 (to an opening 57) over the exhaust path 53. At the branch point, a switching plate 59 capable of pivoting on a shaft 58 is provided. The switching plate 59 is switched by a drive mechanism (not indicated in the drawings) between a vertical position to close the exhaust path 53 as illustrated in FIG. 4 and a horizontal position to close the inlet of the circulation path 56 as illustrated in FIG. 5. For example, the drive mechanism includes a solenoid or a motor as a drive source.

While the switching plate 59 stays in the vertical position as illustrated in FIG. 4, the air taken in through the inlet 54 by rotation of the suction fan 54 passes through the filter 55 (see arrow b) and hits against the switching plate 59. Then, the air is introduced into the circulation path 56 and fed back to the inside of the apparatus through the opening 57 (see arrow c). While the switching plate 59 stays in the horizontal position, the air passes through the filter 55 and goes straight in the exhaust path 53 (see arrow b') to the outside of the apparatus.

In order to monitor the fixing temperature, a temperature sensor SE11 is provided in the fixing device 30. In order to monitor the temperature and the humidity inside the apparatus, a temperature sensor SE12 and a humidity sensor SE13 are provided near the fixing device 30. Two or more temperature sensors and two or more humidity sensors to monitor the temperature and the humidity inside the apparatus may be provided at two or more positions. For example, such temperature sensors and humidity sensors may be further provided in the intermediate transfer unit 20 and/or near the image forming units 10.

Figure 7:
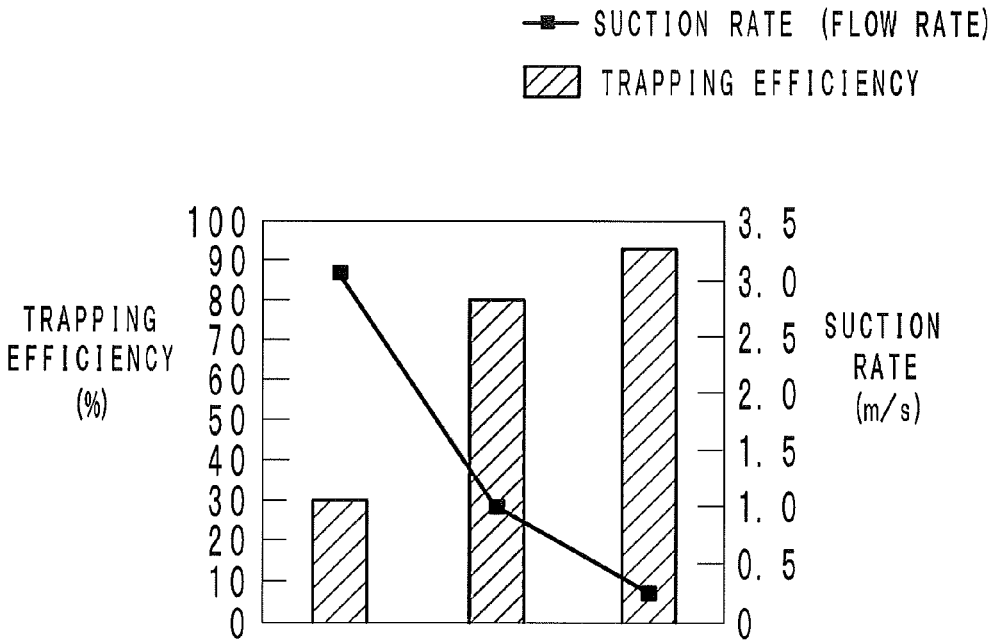
FIG. 7 is a graph indicating suction rate into a filter and particle trapping efficiency.

The suction rate (flow rate) of the suction fan 54 for suction of a sheet is, for example, about 3 m/s. Now, the relation between the suction rate and the particle trapping efficiency of the filter 55 is considered. As illustrated in FIG. 7, when the suction rate is about 3 m/s, the particle trapping efficiency is about 30%, and a large amount of particles slip through the filter 55. This means that exhaust ventilation at the usual suction rate results in a large amount of particle emission. Meanwhile, when the suction rate is reduced to about 1 m/s or to about 0.25 m/s, the particle trapping efficiency rises to about 80 to 95%.

The suction rate of the suction fan 54 is variable by adjusting the amount of power supplied (the voltage applied) to the suction fan 54. It is preferred that the suction rate of the suction fan 54 is variable about within a range from 3 m/s to 0.1 m/s. Also, it is preferred that the switching plate 59 is controlled such that only when the suction rate is equal to or less than a predetermined value (for example, only when the suction rate is equal to or less than 1 m/s, which achieves a particle trapping efficiency of about more than 80%), the switching plate 59 is allowed to open the exhaust path 53. With this control, most of the fine particles floating in the apparatus are trapped by the filter 55 and are not discharged to the outside of the apparatus. With this control, also, when the suction rate is greater than the predetermined value, the switching plate 59 keeps the circulating path 56 open, and the fine particles floating in the apparatus are prevented from being discharged to the outside of the apparatus. Here, the fine particles include toner particles floating from the developing devices as well as ultrafine particles of volatile matters emanating from the rollers 31 and 32 of the fixing device 30 during a heating process.

By locating the suction fan 54 having a function to suck a traveling sheet in one direction at such a position to take in the air around the fixing device 30, it becomes possible to trap a large amount of fine particles.

Further, when it is determined, based on a detection result of the sheet sensor SE2 for detecting the position of a traveling sheet, that a sheet is not at a predetermined position (a position immediately before the fixing device 30), the suction rate may be lowered from the suction rate when a sheet is at the predetermined position. For example, the suction rate is lowered to 0.5 m/s. With this control, while no sheet is traveling immediately before the fixing device 30, the suction rate is lowered, thereby resulting in an increase in the particle trapping efficiency. Whether any sheet is at the predetermined position may be determined based on the detection result of the sheet sensor SE1 and the sheet conveyance speed, instead of based on the detection result of the sheet sensor SE2.

Also, when no print command is given to the image forming units 10 and other members, the suction rate may be lowered from the suction rate when a print command is given. In a standby state of the apparatus, there is no possibility of a temperature rise inside the apparatus, and the suction rate can be lowered. Then, the decrease in the suction rate leads to an increase in the particle trapping efficiency.

Further, when no print command is given and the fixing temperature detected by the temperature sensor SE11 is equal to or lower than a predetermined value, that is, when the printer is in a standby state and the fixing device 30 is at a relatively low temperature (for example, equal to or lower than 140 degrees C.), particulate emanation can be considered little, and therefore, the suction fan 54 can be stopped. This control leads to energy saving and noise reduction.

The suction rate can be determined in any of the following ways. The suction rate can be derived from the voltage applied to the suction fan 54. The suction rate may be determined from the actual measured value of the wind speed near the filter 55. Alternatively, the suction rate can be estimated based on the constant voltage applied to the suction fan 54, the presence or non-presence of a sheet, the kind of sheet, the sheet conveyance mode, etc. A device configured to determine the suction rate is referred to as a suction rate determiner 75 (see FIG. 6).

In the meantime, the suction rate may be changed in accordance with the kind of sheet to be fed and/or the sheet conveyance mode. For example, when a thick paper is fed, the suction rate is lowered from the suction rate when a thin paper or an ordinary paper is fed. For fixation of toner onto a thick paper, a greater amount of heat is necessary, and the fixing temperature is set higher, which increases particulate emanation. Meanwhile, a thick paper is resilient and exhibits stable behavior while being fed, compared with a thin paper. Therefore, a decrease in the suction rate during conveyance of a thick paper leads to an increase in the particle trapping efficiency without causing any problems. During a double-side printing operation, a sheet is curled after undergoing a fixing process by the fixing device 30 for fixation of toner onto a first side of the sheet. Therefore, separation of the sheet from the intermediate transfer belt 21 and feeding of the sheet for fixation of toner onto a second side of the sheet are not so stable as those for fixation of toner onto the first side thereof. Accordingly, it is undesired to decrease the suction rate during printing on a second side of a sheet, but it is possible to decrease the suction rate during printing on a first side of the sheet, which leads to an increase in the particle trapping efficiency.

Thus, by setting the suction rate to an appropriate value in accordance with the kind of a sheet (thick paper or a thin paper) and the sheet feeding mode (sheet feeding during printing on a first side or sheet feeding during printing on a second side), unnecessary increases in the suction rate are avoided, which leads to prevention of a reduction in the particle trapping efficiency. Also, with this control, the suction fan 54 has a suction performance appropriate for each case, and energy saving and noise reduction can be achieved.

The amount of particulate emanation changes depending on the fixing temperature. Different substances start volatilizing at different temperatures, and as the temperature is rising, more substances volatilize. Therefore, it is preferred that the suction rate is controlled in accordance with the temperature detected by the sensor SE11. Thereby, fine adjustment of the suction rate in accordance with the fixing temperature becomes possible, which leads to energy saving and noise reduction. Especially during a warm-up operation immediately after switch-on of the printer, it is likely that a large amount of fine particles emanate. At this time, by circulating the air at an appropriate suction rate (for example, 0.1 m/s), the fine particles can be certainly trapped.

It is preferred that the switching plate 59 is activated to open the exhaust path 53 when the suction rate is equal to or less than a predetermined value (for example, equal to or less than 1.0 m/s) and the temperature inside the apparatus detected by the temperature sensor SE12 is equal to or higher than a predetermined value (for example, equal to or higher than 60 degrees C.). With this control, introduction of heated air into the circulation path 56 is avoided. Thus, it is possible to prevent a rise in the temperature inside the apparatus without reducing the particle trapping efficiency. When the suction rate is equal to or less than the predetermined value and the temperature inside the apparatus detected by the temperature sensor SE12 is lower than the predetermined value, the circulation path 56 may be kept open. In this embodiment, under normal conditions, the suction section 50 is in a state where the circulation path 56 is open.

For determination of the temperature inside the apparatus, temperature measurements may be made at two or more places in the apparatus. Alternatively, the temperature inside the apparatus may be estimated based on the rotation statuses of the rotary members, such as the rollers 31 and 32 of the fixing device 30, the photoreceptor drums 11 of the image forming units 10, the sheet conveyance rollers, etc., or based on the number of printed sheets or the period of time during which sheets are traveling continuously in the sheet path.

Also, it is preferred that the switching plate 59 is activated to open the exhaust path 53 when the suction rate is equal to or less than the predetermined value and the humidity inside the apparatus detected by the humidity sensor SE13 is equal to or higher than a predetermined value (for example, equal to or higher than 85%). With this control, it is possible to prevent due condensation in the apparatus by taking moisture out of the apparatus without reducing the particle trapping efficiency. When the suction rate is equal to or less than the predetermined value and the humidity inside the apparatus detected by the humidity sensor SE13 is less than the predetermined value, the circulation path 56 may be kept open.

Control Unit; See FIG. 6

Figure 6:
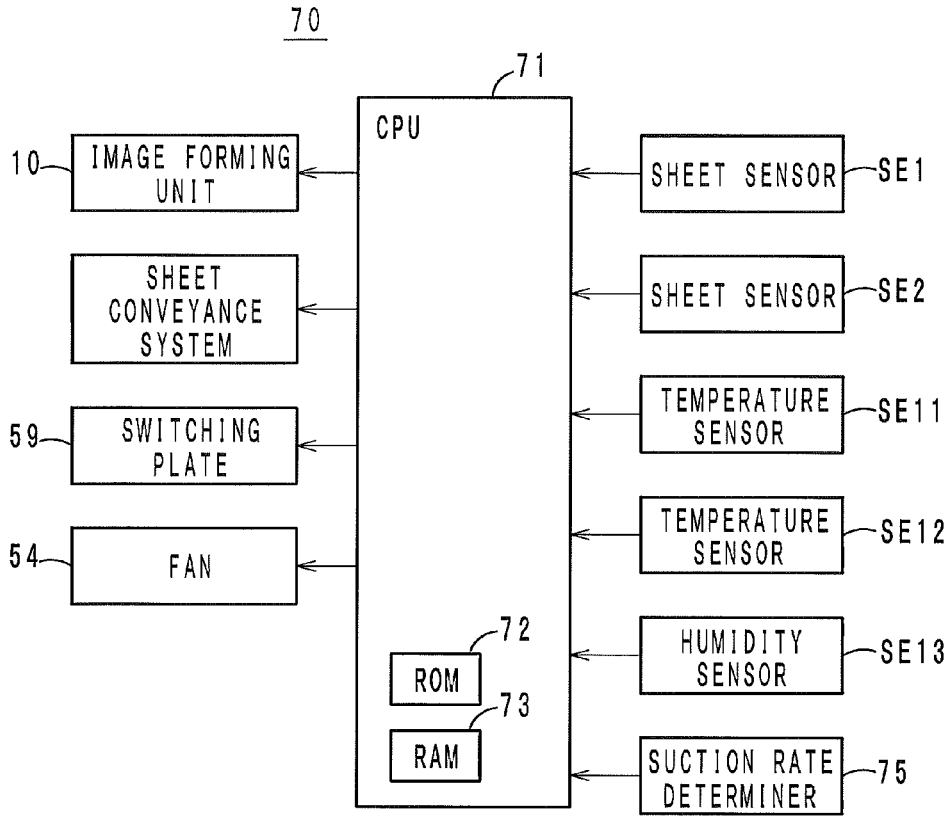
FIG. 6 is a block diagram of a control circuit.

The printer is controlled by a control unit 70 illustrated in FIG. 6. The main component of the control unit 70 is a CPU 71, and the CPU 71 includes an embedded ROM 72 storing a program therein and an embedded RAM 73 that is a rewritable memory. The CPU 71 controls the image forming units 10, the sheet conveyance system, the suction fan 54, the switching plate 59 and other members in conformity with information included in a print command. To the CPU 71, information about detection results are sent from the sensors SE1, SE2, SE11, SE12 and SE13, and information about the suction rate is sent from the suction rate determiner 75.

Control Procedure; See FIGS. 8-13

Figure 8:
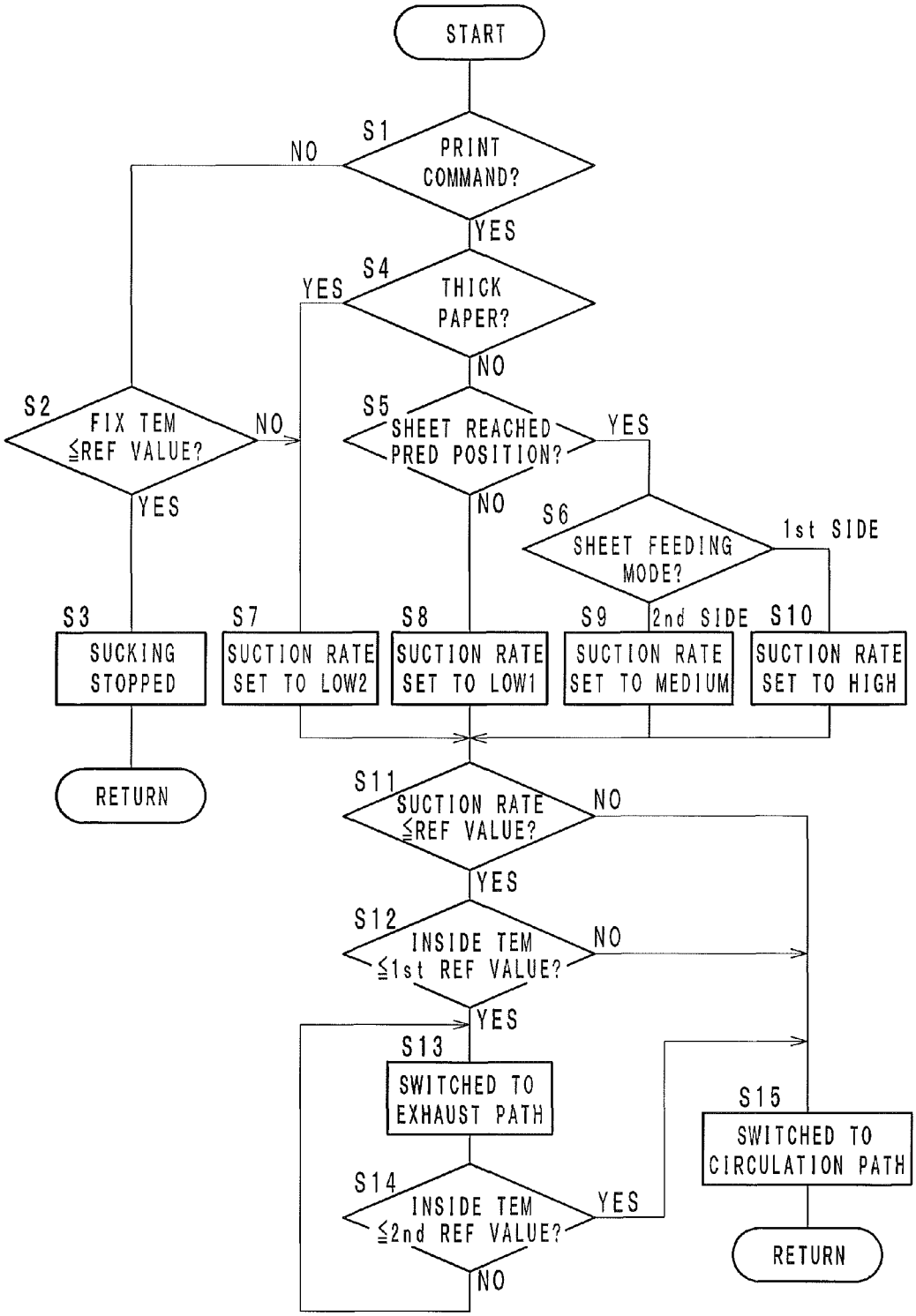
FIG. 8 is a flowchart illustrating a control procedure to trap particles.
Figure 10:
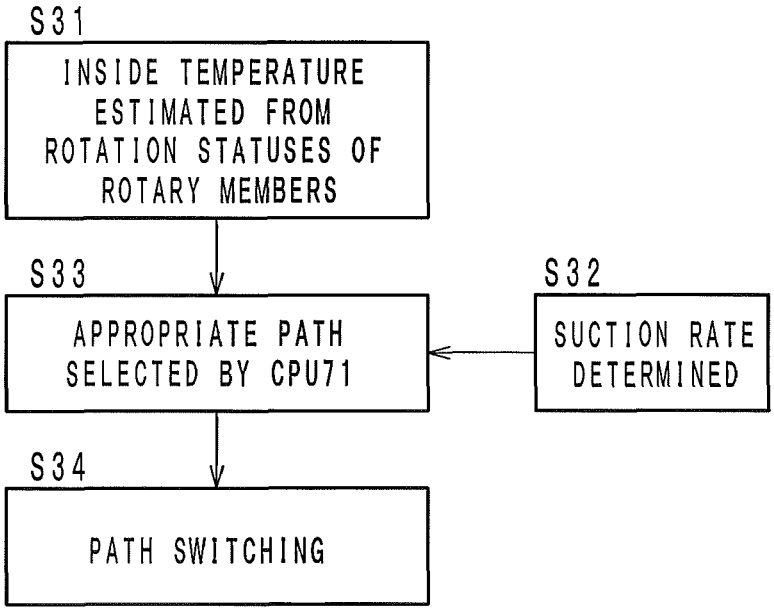
FIG. 10 is a flowchart illustrating a second way of making a switch between the exhaust path and the circulation path depending on the temperature inside the printer.
Figure 11:
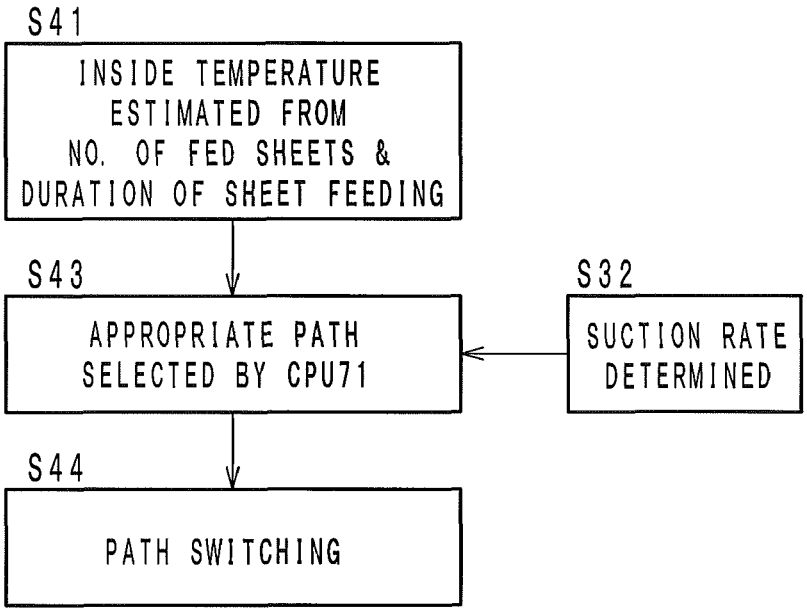
FIG. 11 is a flowchart illustrating a third way of making a switch between the exhaust path and the circulation path depending on the temperature inside the printer.
Figure 12:
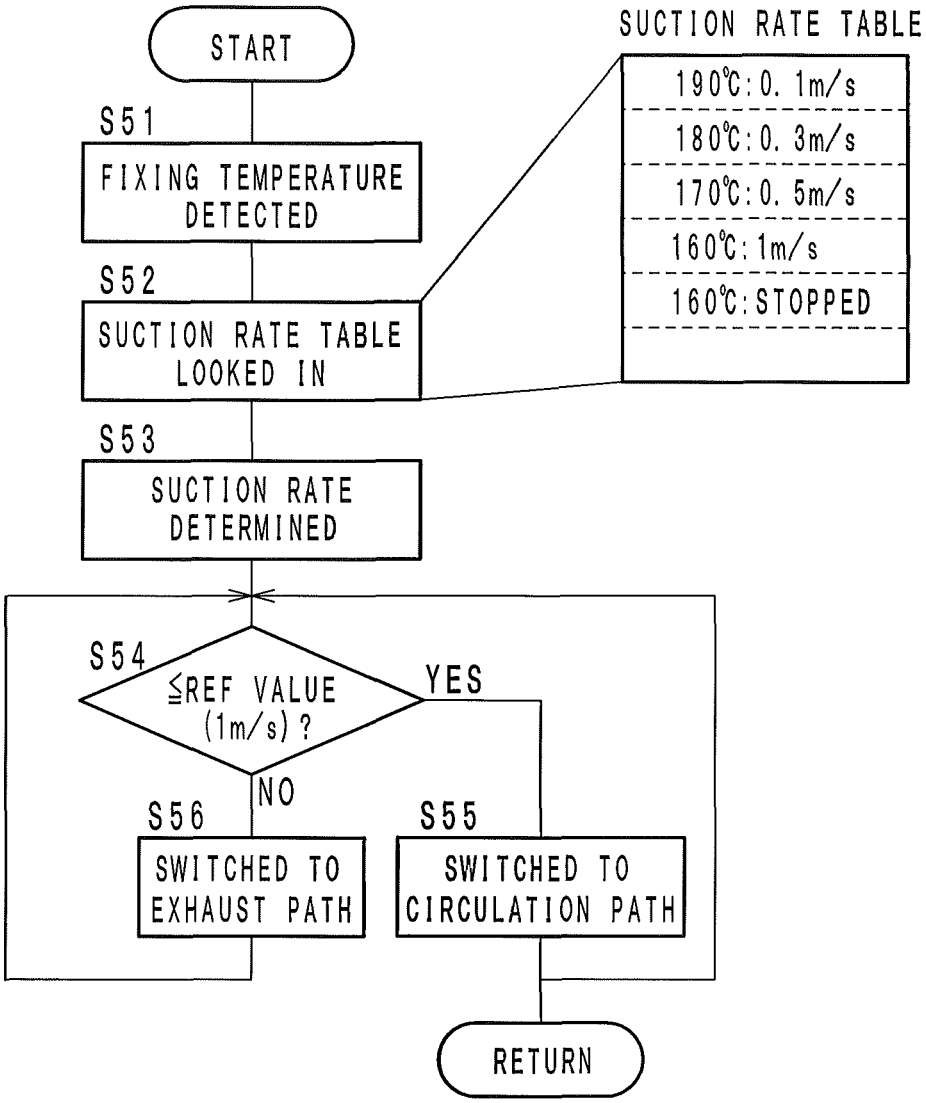
FIG. 12 is a flowchart illustrating a control procedure to make a switch between the exhaust path and the circulation path depending on the fixing temperature.
Figure 13:
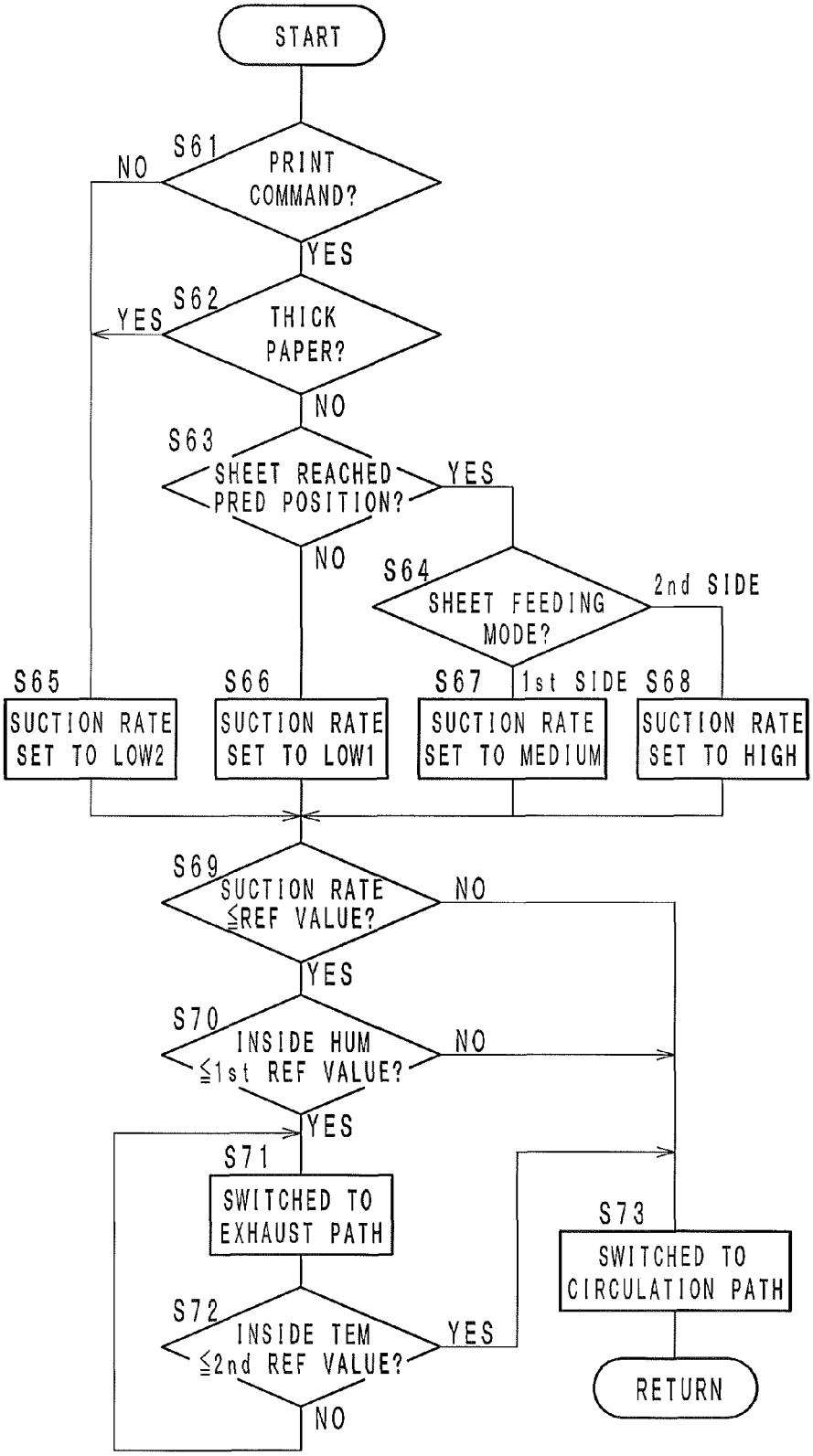
FIG. 13 is a flowchart illustrating a control procedure to make a switch between the exhaust path and the circulation path depending on the humidity inside the printer.

Referring to FIGS. 8-13, a procedure to control the suction section 50 for trapping of fine particles is described below. FIGS. 8, 12 and 13 indicate subroutines selectively carried out by the CPU 71. Under a first control procedure, as illustrated in FIG. 8, if no print command is given (standby state, NO at step S1) and if the fixing temperature is equal to or less than a predetermined value (140 degrees C.) (YES at step S2), the sucking operation by the suction fan 54 is stopped (step S3). If the fixing temperature is higher than the predetermined value (NO at step S2), the suction rate is set to a speed of "LOW 2" (0.1 m/s) (step S7).

When the CPU 71 receives a print command (YES at step S1), the sheet information is analyzed, and if the sheet to be printed is a thick paper (YES at step S4), the suction rate is set to the speed of "LOW 2" (0.1 m/s) (step S7). If the sheet to be printed is not a thick paper (NO at step S4) and if it is before the sheet reaches the predetermined position (position immediately before the fixing device 30) (NO at step S5), the suction rate is set to a speed of "LOW 1" (step S8). When the sheet reaches the predetermined position (YES at step S5) and if it is during printing on a first side of the sheet (step S6), the suction rate is set to a medium speed (2 m/s) (step S9). If it is during printing on a second side of the sheet, the suction rate is set to a high speed (3 m/s) (step S10).

Next, if the suction rate is equal to or less than a reference value (1 m/s) (YES at step S11) and if the temperature inside the apparatus is equal to or higher than a first reference temperature (60 degrees C.) (YES at step S12), the exhaust path 53 is opened (step S13). Then, when the temperature inside the apparatus becomes equal to or less than a second reference temperature (50 degrees C.) (YES at step S14), the circulation path 56 is opened (step S15). On the other hand, if the suction rate is more than the reference value (1 m/s) (NO at step S11) and if the temperature inside the apparatus is lower than the first reference temperature (60 degrees C.) (NO at step S12), the circulation path 56 is opened (step S15).

Figure 9:
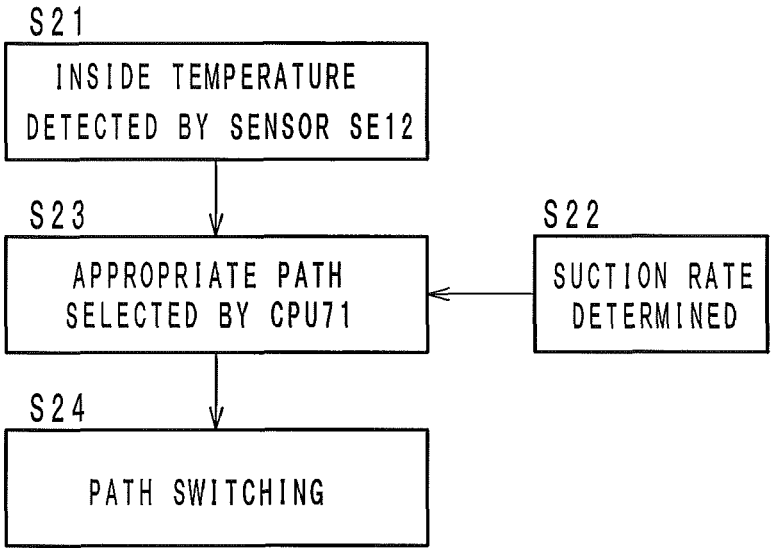
FIG. 9 is a flowchart illustrating a first way of making a switch between the exhaust path and the circulation path depending on the temperature inside the printer.

The temperature at the predetermined position in the apparatus is detected or estimated in one of the ways illustrated in FIGS. 9, 10 and 11, and based on the detected or estimated temperature and the suction rate, path switching between the exhaust path 53 and the circulation path 56 is performed. In the first way illustrated in FIG. 9, the temperature inside the apparatus is detected by the temperature sensor SE12 (step S21). Then, the detected value is input to the CPU 71, and the suction rate determined by the suction rate determiner 75 at that time is input to the CPU 71 (step S22). Based on both the information about the temperature and the information about the suction rate, the CPU 71 selects an appropriate path from the paths 53 and 56 (step S23), and makes a switch to the selected path (step S24).

In the second way illustrated in FIG. 10, the temperature inside the apparatus is estimated from the rotation statuses of the photoreceptor drums 11 and other rotary members (step S31). Then, the estimated value is input to the CPU 71, and the suction rate determined by the suction rate determiner 75 at that time is input to the CPU 71 (step S32). Based on both the information about the temperature and the information about the suction rate, the CPU 71 selects an appropriate path from the paths 53 and 56 (step S33), and makes a switch to the selected path (step S34).

In the third way illustrated in FIG. 11, the temperature inside the apparatus is estimated from the number of fed sheets and the duration of sheet feeding (step S41). Then, the estimated value is input to the CPU 71, and the suction rate determined by the suction rate determiner 75 at that time is input to the CPU 71 (step S42). Based on both the information about the temperature and the information about the suction rate, the CPU 71 selects an appropriate path from the paths 53 and 56 (step S43), and makes a switch to the selected path (step S44).

Now, referring to FIG. 12, a control procedure to perform path switching based on the fixing temperature is described. First, the fixing temperature is detected by the sensor SE11 (step S51). The control unit 71 looks in a suction rate table for a suction rate corresponding to the fixing temperature (step S52) and determines the suction rate (step S53). Next, the control unit 71 determines whether the suction rate is equal to or less than the reference value (1 m/s) (step S54). If the suction rate is equal to or less than the reference value, the circulation path 56 is opened (step S55), and if the suction rate is more than the reference value, the exhaust path 53 is opened (step S56). It is to be noted that in conformity with the indication in the suction rate table, if the fixing temperature is equal to or lower than 140 degrees C., the sucking operation is stopped.

Next, referring to FIG. 13, a control procedure to perform path switching based on the humidity inside the apparatus is described. When no print command is given (NO at step S61), the suction rate is set to the speed of "LOW 2" (0.1 m/s) (step S65). When a print command is given, the control unit 71 checks out the information about the sheet (step S62). If the sheet is a thick paper (YES at step S62), the suction rate is set to the speed of "LOW 2" (0.1 m/s) (step S65). If the sheet is not a thick paper (NO at step S62) and if the sheet has not reached the predetermined position (position immediately before the fixing device 30) (NO at step S63), the suction rate is set to the speed of "LOW 1" (0.5 m/s) (step S66). When the sheet reaches the predetermined position (YES at step S63) during printing on the first side of the sheet (YES at step S64), the suction rate is set to the medium speed (2 m/s) (step S67). If it is during printing on the second side of the sheet (NO at step S64), the suction rate is set to the high speed (3 m/s) (step S68).

If the suction rate is equal to or less than the reference value (1 m/s) (YES at step S69) and if the humidity inside the apparatus is equal to or higher than a first reference humidity (85%) (YES at step S70), the switching plate 59 is activated to open the exhaust path 53 (step S71). When the humidity inside the apparatus becomes equal to or lower than a second reference humidity (50%) (YES at step S72), the circulation path 56 is opened (step S73). On the other hand, if the suction rate is more than the reference value (NO at step S69) and if the humidity inside the apparatus is lower than the first reference humidity (85%) (NO at step S70), the circulation path 56 is opened (step S73).

Second Example of Exhaust Section; See FIG. 14

Figure 14:
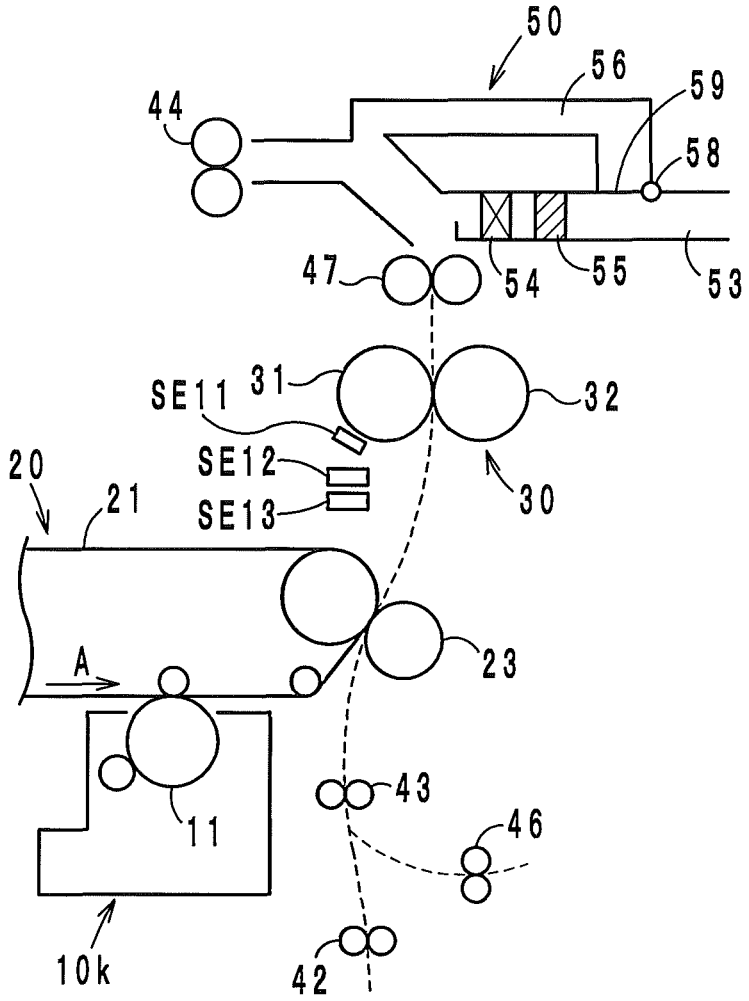
FIG. 14 is an elevational view of a second example of an exhaust section of the printer.

As illustrated in FIG. 14, the suction section 50 may be located immediately above the fixing device 30. In a second example of the suction section 50, the suction section 50 is located between a pair of rollers 47 located at an outlet side of the fixing device 30 and the pair of ejection rollers 44. The second example of the suction section 50 has a similar structure to the structure illustrated in FIG. 3, and is controlled in a similar way as described above. Therefore, the detailed descriptions of the structure and the control method of the second example of the suction section 50 are omitted here. The suction section 50 is not necessarily located near the fixing device 30. The suction section 50 may be provided as a cooling system for cooling the image forming units 10. Alternatively, the suction section 50 may be provided near an ozone sucking section or any other source of vacuum. In such a case, also, the suction section 50 traps particles efficiently.

Other Embodiments

The present invention is applicable not only to the printer according to the embodiment described above but also to other various image forming apparatuses, such as a multifunctional apparatus having a function as a copier and a function as a facsimile. The structure of the sheet path and the structure of the fixing device may be arbitrarily designed, and the detailed structure of the suction section may be arbitrarily designed.

Although the present invention has been described in connection with the preferred embodiments above, it is to be noted that various changes and modifications may be obvious to persons having ordinary skill in the art. Such changes and modifications are to be understood as being within the scope of the present invention.

What is claimed is:

1. An image forming apparatus comprising:

an image forming section configured to transfer a toner image to a recording sheet and to fix the toner image on the recording sheet by heat;

a filter member configured to trap particles floating in the image forming apparatus;

a suction section configured to suck air including the particles at a variable suction rate;

a determiner configured to determine the suction rate of the suction section;

an exhaust path capable of leading the air sucked by the suction section to outside of the image forming apparatus through the filter member;

a circulation path capable of allowing the air sucked by the suction section and passing through the filter member to circulate inside the image forming apparatus;

a switching member configured to make switches between the exhaust path and the circulation path; and a control unit configured to control at least the suction section and the switching member, wherein the control unit allows the switching member to open the exhaust path only when the suction rate determined by the determiner is equal to or less than a predetermined value.

2. The image forming apparatus according to claim 1, wherein the suction section has a function to suck a traveling recording sheet in one direction.

3. The image forming apparatus according to claim 1, wherein the control unit activates the switching member to open the exhaust path when the suction rate determined by the determiner is equal to or less than the predetermined value.

4. The image forming apparatus according to claim 1, further comprising at least one sensor configured to detect a position of a traveling recording sheet, wherein the control unit controls the suction rate of the suction section based on a detection result of the sensor such that the suction rate when the recording sheet is not at a predetermined position is lower than the suction rate when the recording sheet is at the predetermined position.

5. The image forming apparatus according to claim 1, wherein the control unit controls the suction rate of the suction section such that the suction rate when a print command is not given is lower than the suction rate when a print command is given.

6. The image forming apparatus according to claim 1, wherein the control unit stops operation of the suction section when a print command is not given and a fixing temperature is equal to or lower than a predetermined temperature.

7. The image forming apparatus according to claim 1, wherein the control unit controls the suction rate based on a kind of a traveling recording sheet and/or a sheet feeding mode.

8. The image forming apparatus according to claim 1, wherein the control unit controls the suction rate based on a fixing temperature.

9. The image forming apparatus according to claim 1, wherein the control unit activates the switching member to open the exhaust path when the suction rate determined by the determiner is equal to or less than the predetermined value and a temperature at a predetermined position inside the image forming apparatus is equal to or higher than a predetermined value.

10. The image forming apparatus according to claim 1, wherein the control unit controls the switching member to keep the circulation path open when the suction rate determined by the determiner is equal to or less than a predetermined value and a temperature at a predetermined position in the image forming apparatus is lower than a predetermined value.

11. The image forming apparatus according to claim 9, wherein temperatures at one or more predetermined positions inside the image forming apparatus are detected.

12. The image forming apparatus according to claim 9, wherein the control unit estimates the temperature at the predetermined position from a rotation status of a rotary member.

13. The image forming apparatus according to claim 9, wherein the control unit estimates the temperature at the predetermined position from a number of printed sheets and a duration of sheet feeding.

14. The image forming apparatus according to claim 1, wherein the control unit activates the switching member to open the exhaust path when the suction rate determined by the determiner is equal to or less than a predetermined value and a humidity at a predetermined position in the image forming apparatus is equal to or higher than a predetermined value.

15. The image forming apparatus according to claim 1, wherein the control unit control the switching member to keep the circulation path open when the suction rate determined by the determiner is equal to or less than a predetermined value and a humidity at a predetermined position in the image forming apparatus is lower than a predetermined value.

* * * * *